US008408147B2

(12) United States Patent
Holloway et al.

(10) Patent No.: US 8,408,147 B2
(45) Date of Patent: Apr. 2, 2013

(54) CARDS SAFE

(75) Inventors: Christopher John Holloway, Hindhead (GB); Trond Rornes, Hindhead (GB); Alan Hawkins, Canterbury (GB); Nick Brown, Ticshurst (GB); Lee Manvell, Weymouth (GB)

(73) Assignee: Cardssafe, Ltd., Bordon, Hampshire (GB)

( * ) Notice: Subject to any disclaimer, the term of this patent is extended or adjusted under 35 U.S.C. 154(b) by 0 days.

(21) Appl. No.: 10/537,340

(22) PCT Filed: Dec. 5, 2003

(86) PCT No.: PCT/GB03/05297

§ 371 (c)(1),
(2), (4) Date: Dec. 16, 2005

(87) PCT Pub. No.: WO2004/053271

PCT Pub. Date: Jun. 24, 2004

(65) Prior Publication Data

US 2006/0137412 A1 Jun. 29, 2006

(30) Foreign Application Priority Data

Dec. 6, 2002 (GB) ..... 0228448.7

(51) Int. Cl.
*E05G 1/00* (2006.01)

(52) U.S. Cl. ..... 109/56; 109/53; 70/85; 70/232

(58) Field of Classification Search ..... 70/63, 78, 70/85, 220, 232, 77; 109/23, 53, 5, 56
See application file for complete search history.

(56) References Cited

U.S. PATENT DOCUMENTS

| | | | | |
|---|---|---|---|---|
| 845,815 | A * | 3/1907 | Pfleger | 70/63 |
| 1,060,018 | A * | 4/1913 | Pape | 109/56 |
| 1,171,185 | A * | 2/1916 | Fox et al. | 70/85 |
| 2,775,947 | A * | 1/1957 | Mosler | 109/56 |
| 3,842,761 | A | 10/1974 | Bloom | |
| 3,970,010 | A * | 7/1976 | Cantley | 109/56 |
| 4,341,166 | A | 7/1982 | Cantley | |
| 4,638,746 | A * | 1/1987 | Ishigure | 109/52 |
| 4,653,818 | A * | 3/1987 | DeBruyn | 312/246 |
| 5,154,497 | A * | 10/1992 | Smith | 70/85 |
| 5,317,888 | A * | 6/1994 | Towns | 70/63 |
| 5,385,039 | A * | 1/1995 | Feldpausch et al. | 70/78 |

(Continued)

FOREIGN PATENT DOCUMENTS

GB 2241017 8/1991

OTHER PUBLICATIONS

UK Exam. Report of Aug. 23, 2005.

*Primary Examiner* — Christopher Boswell
(74) *Attorney, Agent, or Firm* — John E. Tarcza

(57) ABSTRACT

A cards safe for the safe keeping of credit, debit, and switch cards, or any other small personal item used for making payments or for deposit/security purposes. A card is retained inside a box (30) which is retained by the seller. The box (30) is locked in a secure condition with two locking arms (88), which require a key (70) to unlock them. A locking bar (126) slides across the edge of the box (30) in a slot (46). The key has a protrusion (110), which stops at a correct location to bear against locking arms, which are otherwise biased to a locked state by springs. The key (70) enters the box (30) through a slot (106), and the lock releases. The box (30) can only be opened with the unique key.

37 Claims, 8 Drawing Sheets

U.S. PATENT DOCUMENTS 5,870,910 A * 2/1999 Specht ..... 70/58
5,905,446 A * 5/1999 Benore et al. ..... 109/53
6,347,848 B1 * 2/2002 Cho ..... 70/78
6,490,893 B1 12/2002 Benion
6,591,765 B2 * 7/2003 Braddock ..... 109/45
7,028,621 B2 * 4/2006 Mercier ..... 109/56
2002/0170473 A1 11/2002 Fettis et al.
2002/0186131 A1 12/2002 Fettis
2005/0011423 A1 * 1/2005 Mercier ..... 109/45
2006/0232381 A1 * 10/2006 Gauthier ..... 70/85

* cited by examiner

FIG 5
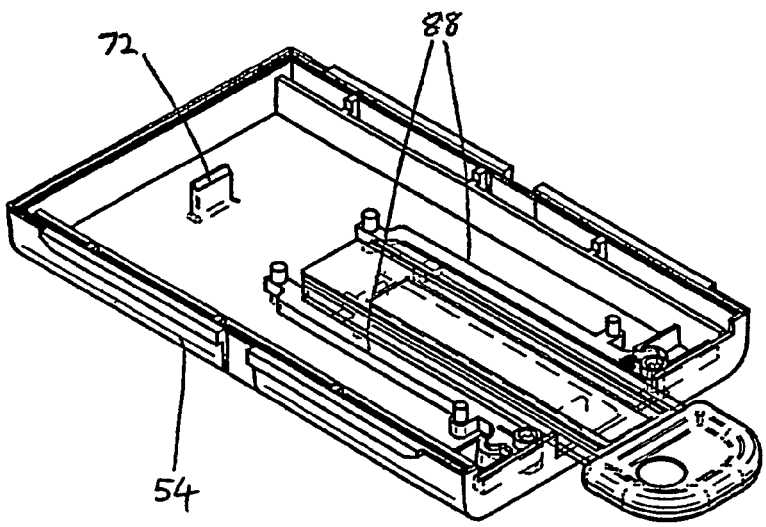
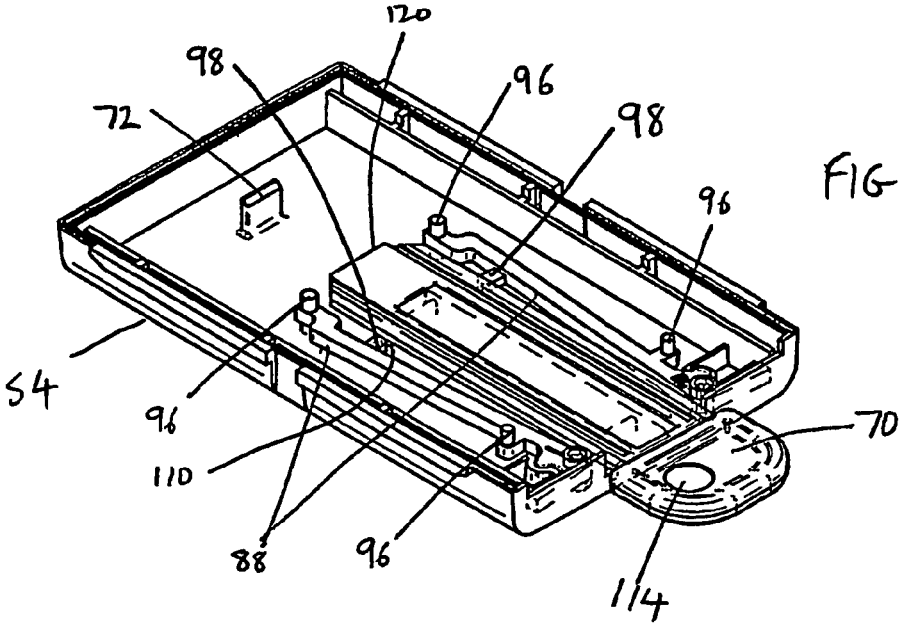
FIG 6

CARDS SAFE

The invention relates to a system that involves, and at the same time secures, two parties, i.e. a cardholder/consumer/customer (the consumer) and an establishment/seller/vendor (the seller) for a period of time during which the consumer is using the seller's facilities.

Credit (or debit) cards have been around for many years. In recent years there has been a proliferation of credit cards. They are being used more frequently as they are often a more convenient way of making higher priced purchases, as opposed to cash. Therefore the use of such cards in everyday purchases has become more frequent.

Consumer situations in which a deposit of some kind needs to be left with a seller for security also are increasing. These situations have often compromised one party or have embarrassed one of the (or both) parties. For example, often a consumer will not want to surrender a credit (or debit) card for fear of it being cloned, copied, or swiped without authorisation. Therefore, in such situations, trust has to be relied upon by the consumer for the safe keeping of the card by the seller. Trust often however, is insufficient. There is an increasing amount of fraud world-wide. For example, there are fraudsters at large, employed by unknowing sellers, who will accept money from illegal card cloners, and the like, for providing details of consumers' credit cards held by them Further, due to the often-regular-turnaround of employees at certain establishments such as pubs, sports halls and golf clubs, the seller cannot necessarily ensure that the employees are trustworthy. Therefore, the more often a credit card is away from the cardholder's own safe keeping, the more opportunity there is for a fraudster to get hold of it to perpetrate a fraudulent crime against the cardholder. Therefore, the conditions up until now in such situations have mostly been in favour of the seller—the consumer has not got any clear security measures for the card, yet he still wants to use the seller's facilities, but he cannot use the facilities without surrendering a card or paying some other kind of deposit.

Therefore, sellers have been seeking with increasing regularity, and for quite some time now, and to no avail, an alternative means to provide a reliable and secure means for taking a deposit (or the like) from consumers while the consumers are using the seller's facilities, without actually having to take a prior payment from the consumer.

According to the present invention there is provided a cards safe for securing credit cards, identity cards, and the like, in an establishment such as a hotel, a golf course, a pub or a bar or some other establishment that provides a service or a product that requires a security payment or a deposit as security prior to sale, use, hire or disposal of the product or service, wherein the safe comprises compartments for such cards, so that the cards provide the deposit or security, the cards safe being adapted such that access to the contents of a particular compartment is exclusively at the control of the consumer using that compartment by means of a lock and a key, wherein each compartment comprises a unique key for retention by the customer when using the cards safe.

Preferably the cards safe is adapted to be attached to a wall by a securement means.

Preferably the securement means comprises screws or bolts.

Preferably the lock is adapted to lock a compartment upon removal of the key for that compartment from the cards safe.

Preferably the lock is adapted to unlock a compartment upon inserting the key for that compartment into the cards safe.

Preferably each compartment comprises its own self-contained lock

Preferably, each compartment comprises a slot therein for the key for that compartment Preferably the cards safe is small enough to fit on a shelf or service counter at the establishment. Preferably the cards safe is no bigger than 40 cm by 40 cm by 20 cm.

Preferably each compartment is adapted to be able to retain a single credit card therein Preferably each compartment is no bigger than 15 cm by 10 cm by 3 cm.

Preferably there are ten compartments.

Preferably the cards safe comprises at least two boxes and a box storage means for storing the boxes, each box forming one of the compartments and being removable from the box storage means.

Preferably the box storage means comprises a rack for multiple boxes.

Preferably the box storage means has a mechanism for locking the boxes in the box storage means in addition to the lock or locks for keeping each box closed. This secondary locking mechanism prevents the boxes from easily being stolen from the establishment.

Preferably the secondary locking mechanism comprises a locking bar running down a side of the boxes. Preferably a slot for the locking bar is provided in a side of each box. Preferably two opposed sides of each box each comprise a slot for a locking bar, the box storage means comprising two locking bars.

Preferably each box comprises runners on two opposed sides thereof, the runners being adapted to run in opposed recesses in the sides of the box storage means.

Preferably the or each locking bar comprises one or more notch through which the runners of a box can pass when the or each locking bar is moved from a locked position to an unlocked position.

Preferably the or each locking bar comprises multiple notched spaces at distances apart that correspond to the distances apart that adjacent recesses are placed, and wherein the or each locking bar can be moved from a locked position to an unlocked position by depressing or lifting the locking bar a distance smaller than that distance.

Preferably the or each locking bar is biased into its locked position. Gravity may, however, alternatively cause the locking bars to default into their locked positions.

Preferably each box comprises a top part, a bottom part and a middle part in the form of a slide, wherein the slide has a tray for receiving a credit card, the slide being adapted to slide between an open position in which the card can be placed on the tray and a closed position in which the slide is between the top and bottom part, the top and bottom parts forming a case around the middle part such as to prevent access to the tray and the card in the closed position.

Preferably the tray comprises a frame sizes to fit closely around the perimeter of a card. Preferably the card is a credit or debit card.

Preferably the lock for each compartment comprises a locking mechanism comprising a rockable locking arm with guides thereon, and grooves for the guides to slide in only when they are correctly aligned with the grooves, wherein the key for the compartment is adapted to correctly align the guides.

Preferably the guides are at two ends of the locking am

Preferably there are two locking arms for each compartment.

Preferably the or each locking arm is biased out of a correctly aligned orientation.

Preferably the compartments or the cards safe prevent reading devices from being able to penetrate the exterior walls of the compartments such that they cannot read the information on cards contained in the compartments. Preferably the compartments or cards safe is manufactured to contain an electromagnetically shielding means.

The present invention also provides a system for securing two parties, the system comprising a cards safe as defined above located in a retail or service providing establishment, the two parties comprising a consumer for the establishment and either the establishment itself or a seller of the establishment, wherein the system provides for the placing of a security or a deposit at the establishment by the consumer, the system requiring the consumer to lock a card, such as a credit card or identity card, in a compartment of the cards safe and, in return for the consumer to retain the key for that container, whereby the establishment or seller retains the card as the security or deposit but without having access to the card, perhaps other than by forceful means.

Preferably, the establishment is a pub, a bar, a restaurant, a hotel reception or a golf course.

The present invention provides a safe means for a seller to keep cards. It secures both the seller and the consumer from the risks associated with the retention of the credit cards or identity cards by the seller. Therefore, the present invention provides security for the consumer in that it avoids the risk of card cloning, copying, swiping, etc., while the consumer is using the seller's facilities. At the same time it provides security for the seller since using the system gives the seller the knowledge that the consumer cannot leave without paying or leaving behind a means to pay or for identifying who the consumer was. In this respect, the term card is intended to incorporate credit cards, debit cards or identity cards such as driving licences or passports.

The cards safe comprises multiple compartments, containers or boxes, each one being for a card. Therefore the cards safe can provide multiple consumers with the comfort of knowing that their card is safe while in the possession of the establishment.

The present invention provides the consumer with a unique key for obtaining his own card back. Because of the present invention's unique key to every compartment, the consumer is reassured in the knowledge that he or s has the only readily available key in their possession while their card is being retained by the seller, locked in the safe. Therefore the present invention greatly diminishes the risk of the consumer's card being cloned, swiped or copied. Other keys might be available, but only for emergencies, such as in the possession of the cards safe's manufacturing company or at some other secure location.

The seller is also secure in the knowledge that the consumer cannot leave the establishment without paying for the products or services rendered, unless the consumer leaves behind their card.

The present invention's primary use will be for bars, restaurants, pubs, hotel receptions, and anywhere else where a card is usually retail outside of the customer's view or away from his personal custody, at any time that Me consumer is a patron of that establishment.

These and other inventive aspects of the present invention are set out in the claims appended hereto. Additionally, the present invention provides the following inventions:

1. The present invention may be designed exclusively for the safe keeping of credit, debit, and switch cards, or any other card used for making payments. If appropriate, the term "card" could be so limited in meaning. However, it is preferable that the term "card" also includes identity cards such as driving licences and passports.

2. The present invention protects the cardholder/customers' card from any fraudulent activity that may occur during the period when the card is not in the possession of the patron, i.e. the consumer.

3. The present invention can only be opened with a unique key, which stays with the patron for the duration of the period for any business conducted between the seller and cardholder.

4. The box of the present invention is made of durable and robust material, which will take considerable force to break and its integrity can only be violated by undue force being applied by an intruder.

5. No card reading devices can penetrate the exterior walls of the box to read the information on the card contained in the box.

The present invention will now be described, by way of example only, with reference to the accompanying drawings, in which:

FIGS. 5 and 6 show the operation of the key mechanism of the present invention;

Figure 1:
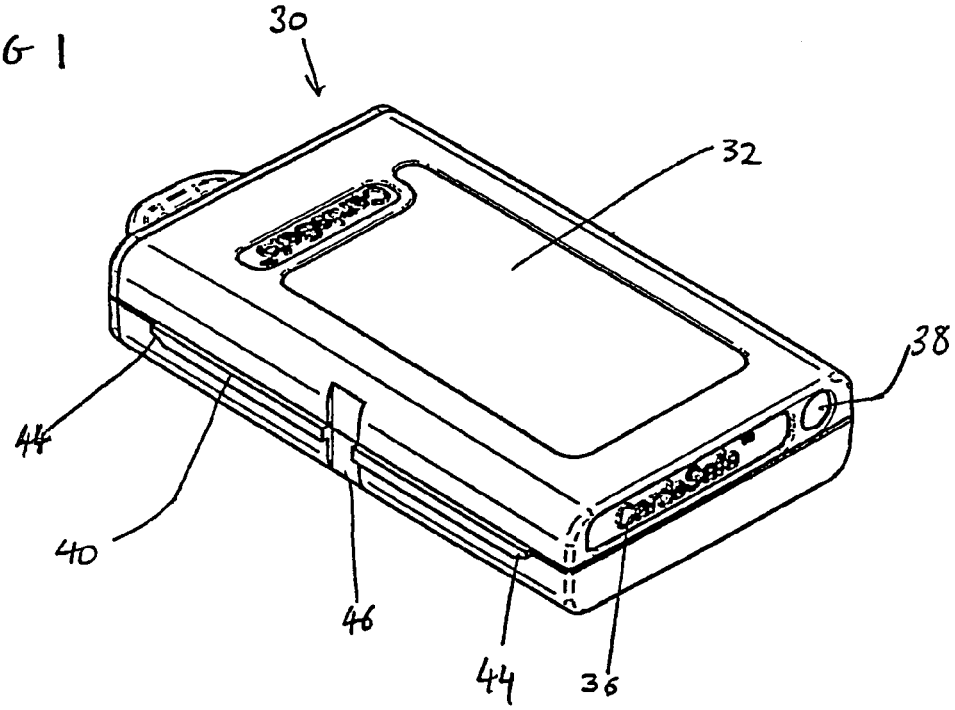
FIGS. 1 and 2 show front and rear perspective views of a box of the present invention.

In brief the unit 20 consist of three separate components:

a) A plurality of boxes 30, each adapted to contain an item to be protected;

b) A unique lock and key 70 for each box 30 which secures each box 30 in a closed state; and c) A rack 80 into which ten boxes 30 can be securely stored.

Figure 2:
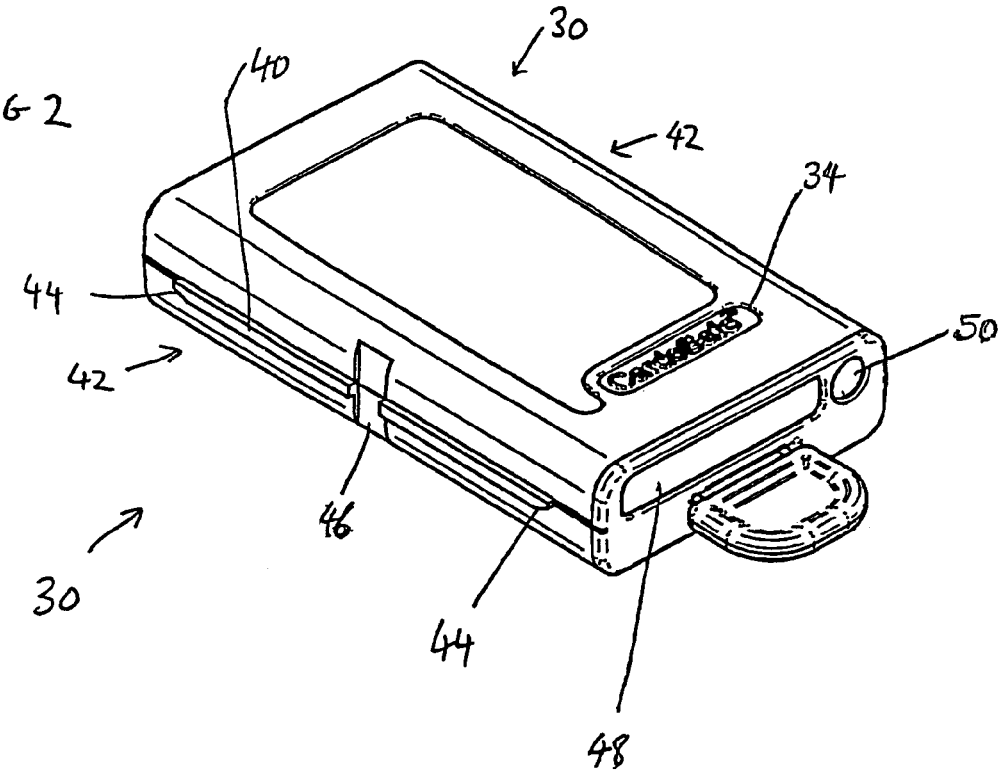

Referring now to FIGS. 1 and 2, each box 30 comprises the following features on its outside:

A top recess 32, which can hold self adhesive labels or adverts;

A top front recess 34, which contains the embossed product logo—CardsSafe in this instance;

An end recess 36, which also contains the embossed logo;

A circular end recess 38, which contains a unique number (this number corresponds with a number assigned to each key);

A solid runner on 40 each side 42, which holds the box 30 in a correct position inside the rack 80. This is until the box 30 is released by depressing push rods 82 at the top 84 of the rack 80 (see FIGS. 9, 10, 12 and 13 and the later description), for example with thumbs;

A lead feature 44 on each end of each of the runners 40 which can be used to guide the box 30 into the right position inside the rack 80;

A slot 46 on each side of the box 30 into which the push rod 82 slides down, to secure the box 30 inside the rack 80;

A front recess 48, which can hold a self adhesive label or an advert; and

A circular front recess 50, which contains the unique number.

Figure 3:
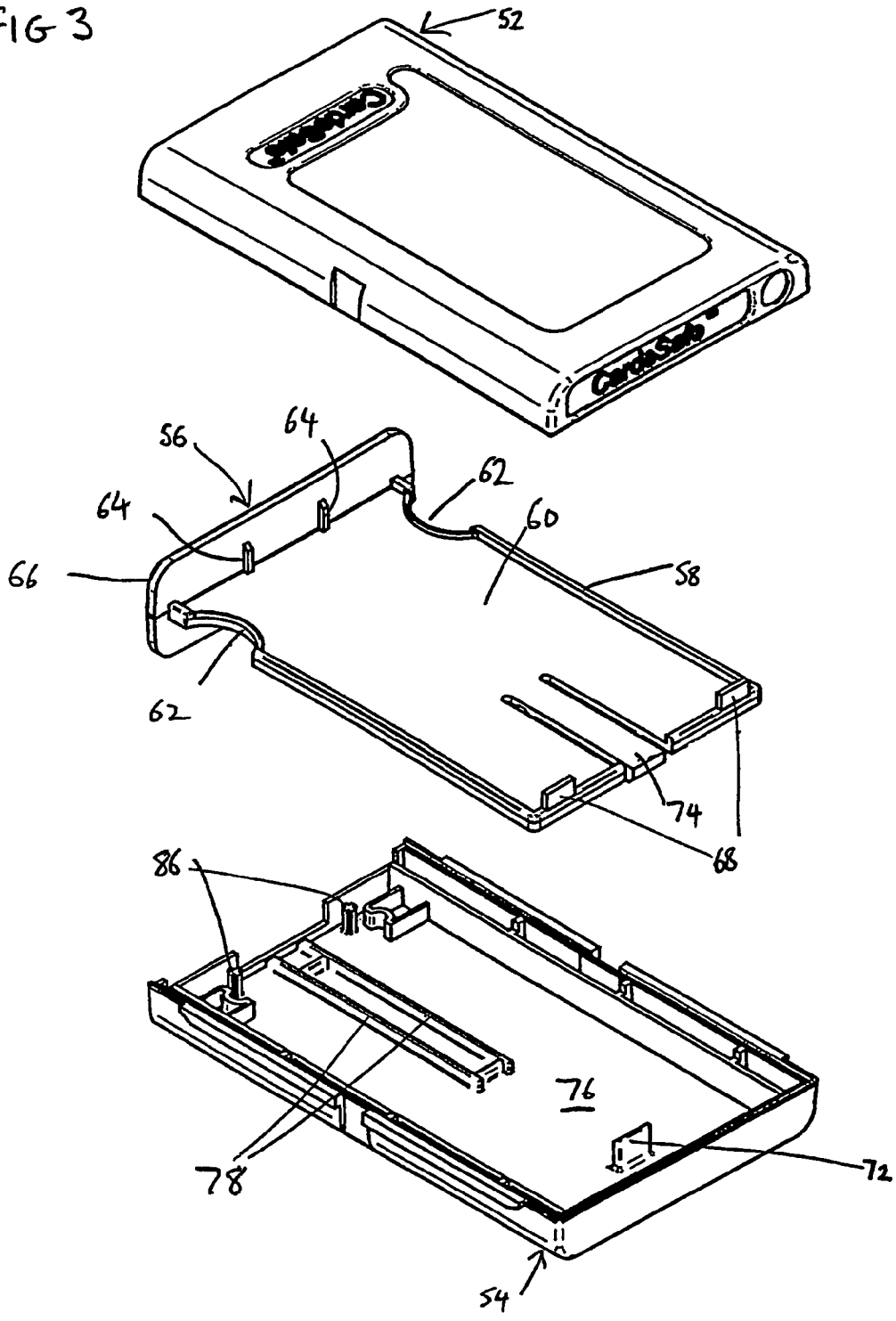
FIGS. 3 and 4 show exploded top and bottom perspective views, respectively, of the box of the present invention.
Figure 4:
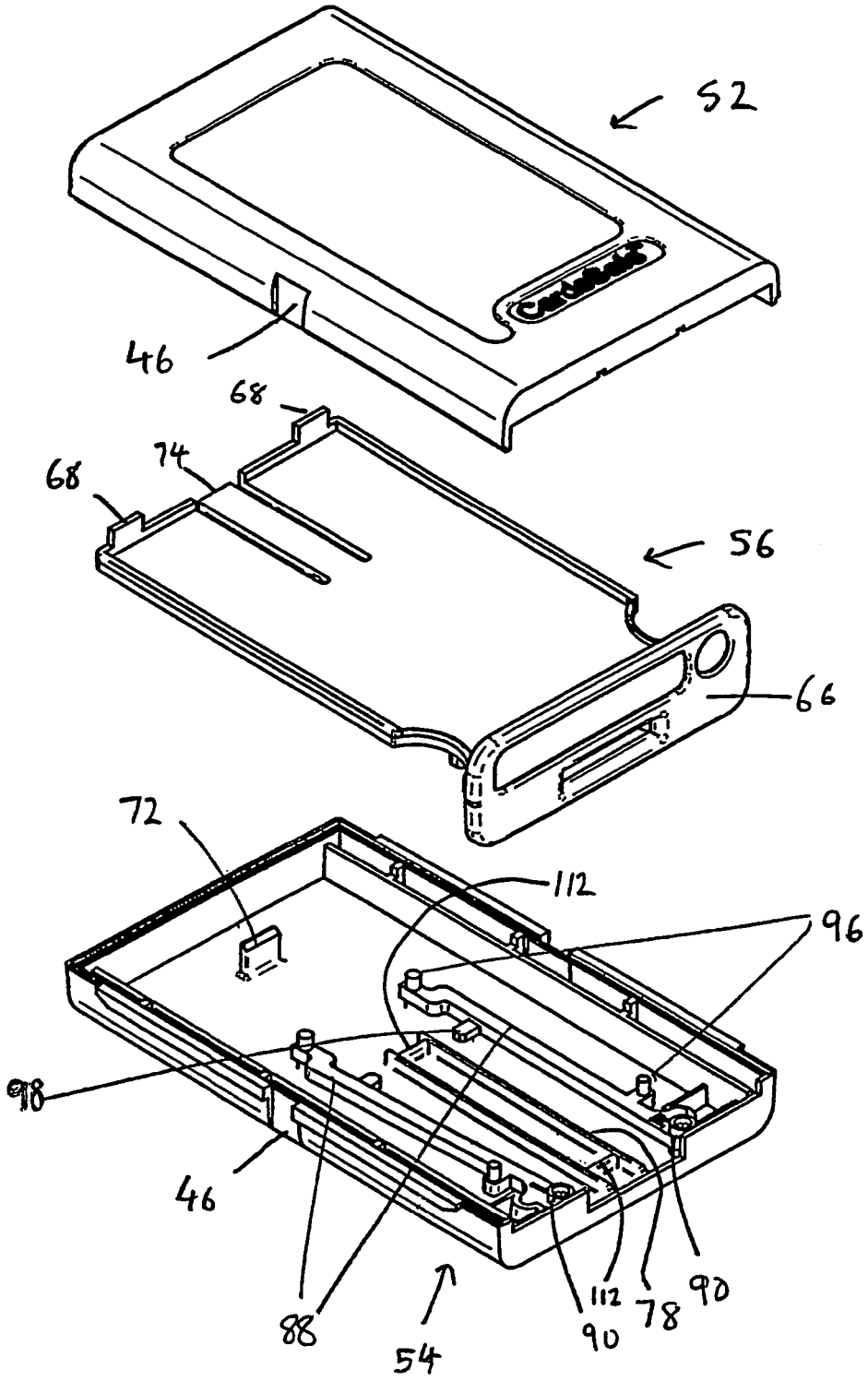

Referring now to FIGS. 3 and 4, each box 30 is made up of three main parts:

A top part 52;

A bottom part 54, which is attached to the top part to form a secure box; and A middle part, which is a slide 56 onto which a card to be protected, or more than one card, can be placed.

The outside edge of the slide 56 has a frame 58, which upstands from the slide's main body 60 to prevent cards from moving outside of the boundaries of the slide 56. The frame 58 extends substantially around the entire circumference of the main body 60. However, gaps are provided at finger grips 62 that are provided on two sides of the main body 60 for assisting with the removal of the card from within the fame. Additionally, end tabs 64 are also provided as part of the frame. The end tabs additionally form reinforcement for the connection of an end face 66 to the main body 60 of the slide 56.

The top part 52, the bottom part 54 and the middle slide 56 are each integrally formed, preferably by injection moulding.

The slide 56 has two webs 68 sticking up at either side of its end opposite the end face 66 to prevent it from sliding out of the box 30 when it is slid from its closed position to its fully opened position.

The slide 56 has a snap 74 at the same end as the two webs 68. It locks the slide 56 in place in its closed position by engaging another web 72, which protrudes from an inside surface 76 of the bottom part 54 of the box 30.

The bottom part 54, which supports the locking parts (as shown in FIG. 4), comprises the protruding web 72 at one end. This part, and also the snap, can be placed in many different positions.

The bottom part 54 also comprises parallel webs 78, which keep the key in the right position and two upstands 86, which retain locking alms 88 securely in their intended positions, as shown in FIG. 4. The key has corresponding grooves (not shown) for the parallel webs 78. The two locking arms 88 have circular mounting ends 90 for fitting over the upstands 86.

The unique lock and key (see FIGS. 5 and 6) comprises two locking arms 88. FIG. 5 shows the bottom part 54 of the box 30, with a key 70 therein having pushed the locking arms 88 aside. FIG. 5 shows the bottom part 54 of the box 30 with the key before the locking arms 88 have been pushed aside. As shown in FIG. 6, the locking arms 88 each have two guides 96 and one lug 98.

Figure 7:
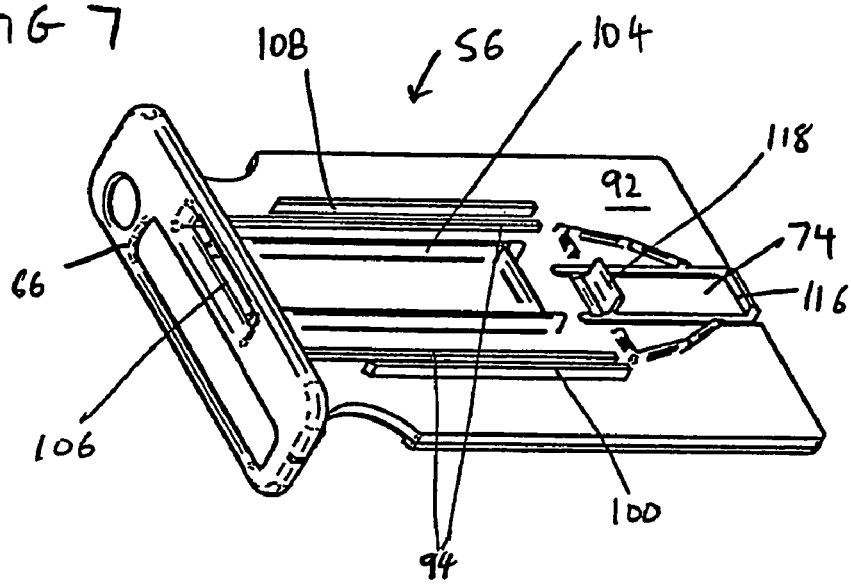
FIGS. 7 and 8 show perspective views of the underside of the slide component of the box.
Figure 8:
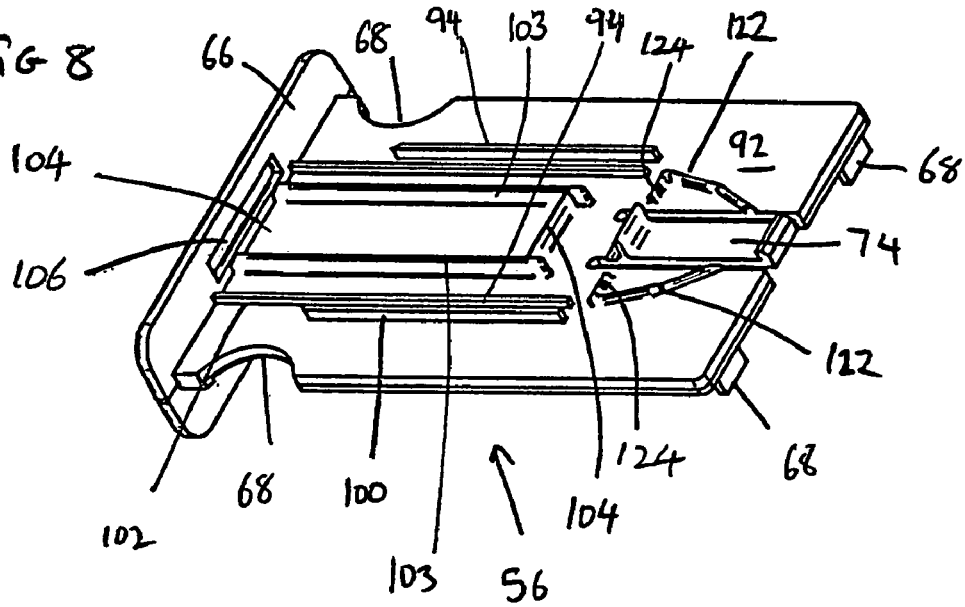
Figure 10:
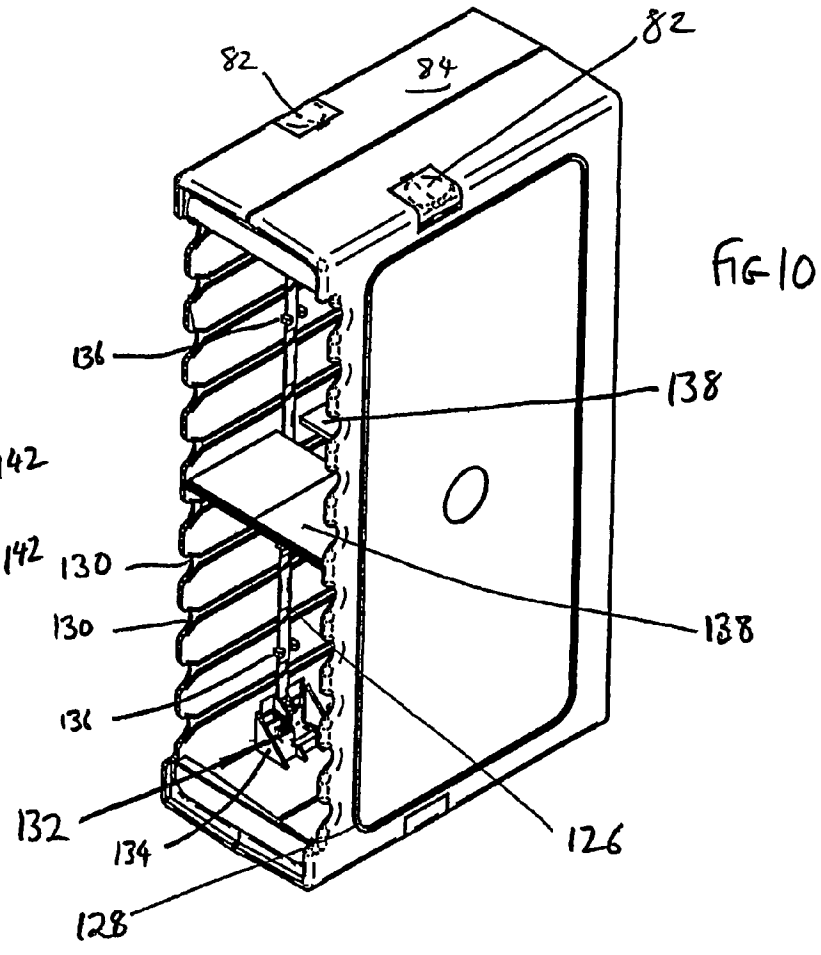
FIGS. 9 and 10 show front and rear perspective views of the rack of the present invention.
Figure 9:
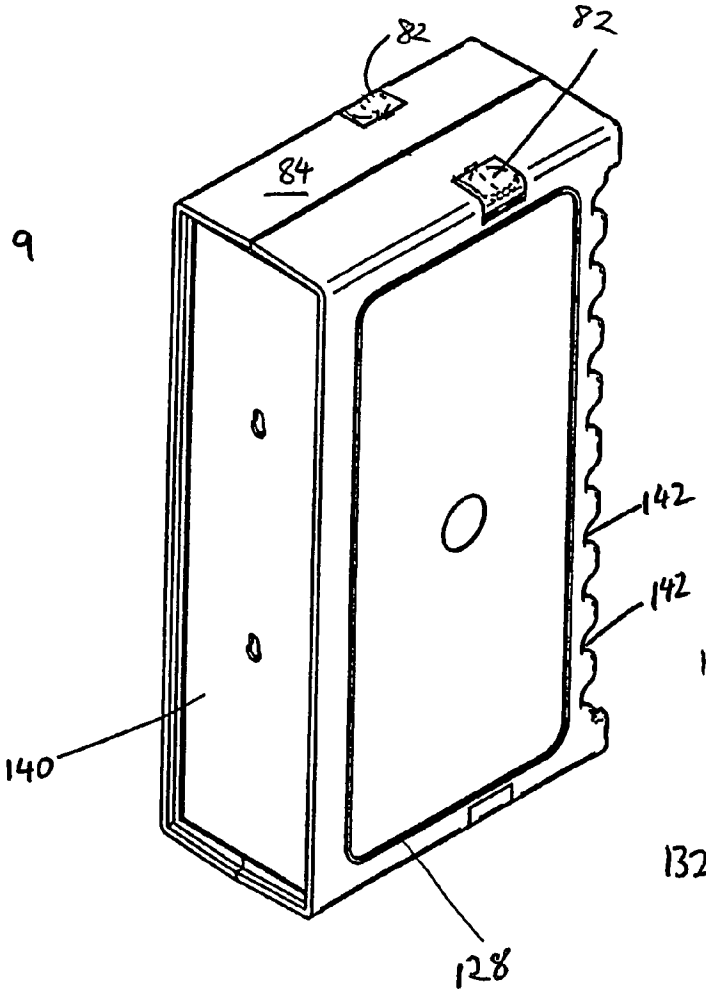
Figure 11:
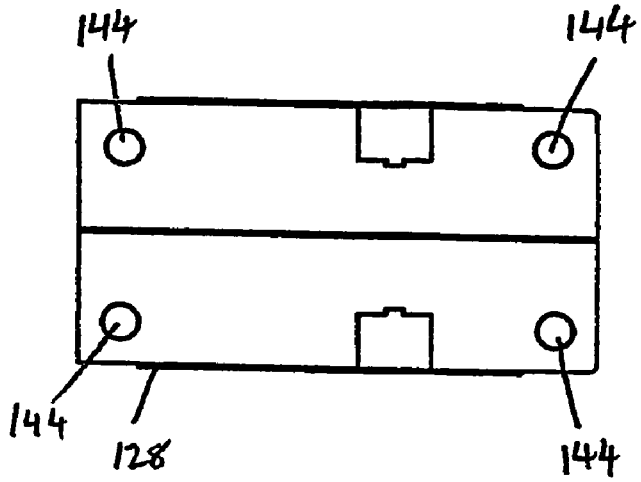
FIG. 11 shows a bottom plan view of the rack.
Figure 12:
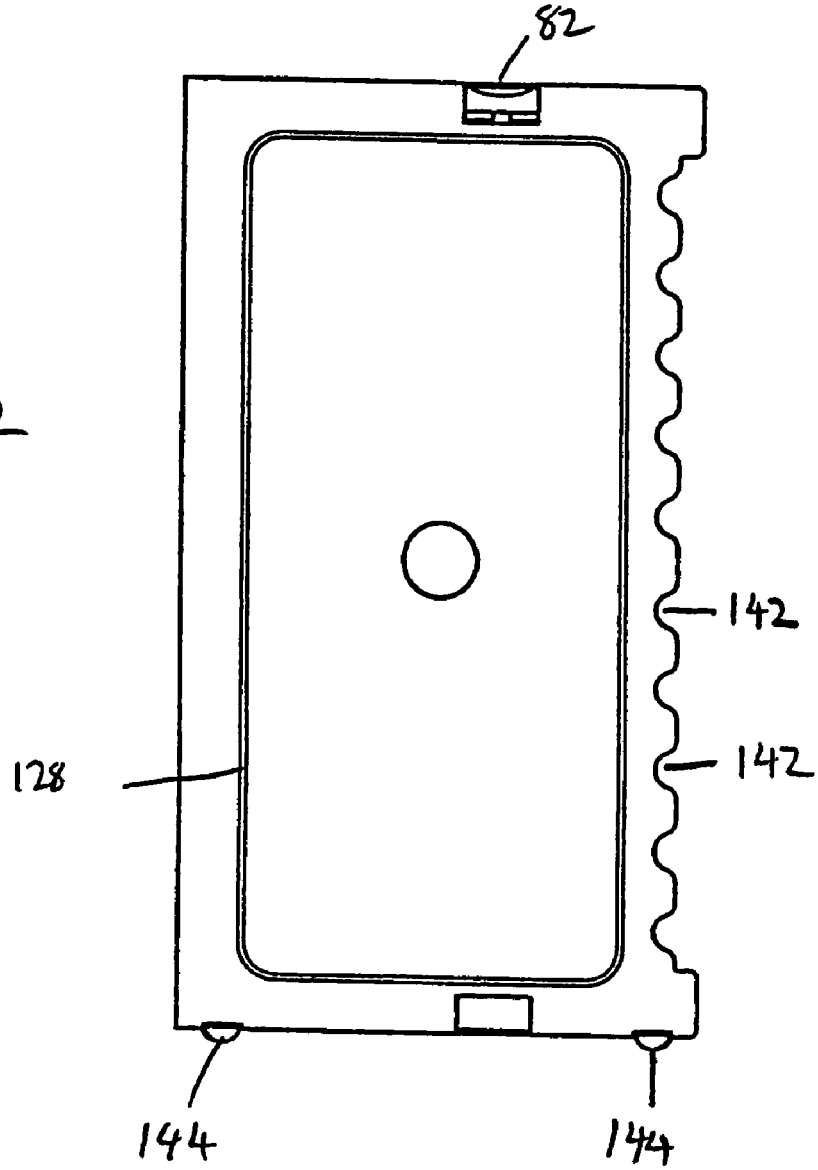
FIG. 12 shows the side elevation of the rack.

Referring to FIGS. 7 and 8, the underside 92 of the slide 56 has various key guides formed thereon. There are the web lines 94 that comprise four parallel webs. They are in pairs. Each pair comprises a first shorter web 100 and a second longer web 102. Between the two pairs of web lines 94 there is also provided further raised portions 104 forming a seat on which the key 70 can slide and sit as it is inserted through a slot 106 provided in the end face 66 of the slide 56. The slide 56 also has parallel webs 103 like the bottom part 54 of the box. Corresponding grooves in the key may again be provided so that the key slides into the box in a straight line.

Each pair of web lines 94 form a channel or groove 108 in which the guide 96 of the locking arms 88 can run as the slide 56 is pushed in or pulled out of the box 30, e.g; for inserting or removing a card therefrom. However, if the guides 96 are not aligned correctly with the grooves 108, the slide will not be able to be removed from the box since the guides 96 will jam the movement of the slide 56.

The key 70 provides the means for correctly aligning the guides 96 with the grooves 198 between the longer webs 102 and the shorter webs 100. The key 70 is provided with an outwardly extending projection 110 on each side thereof (see FIG. 13). Only one projection is shown in FIG. 6. This projection 110 is correctly positioned to engage the lug 98 of the locking arm 88 so as to move the locking arm 88 such that the guides 96 will correctly align in the grooves 108. Although not shown, the locking arms 88 may be biased towards the position shown in FIG. 5 rather than in FIG. 6 by a spring or purely by the resilience of the arms 88. In that default position the two guides 96 at the distal end of the locking arms 88 are closer together than the guides 96 at the proximal ends of the locking arms 88. Therefore the guides 96 will not run in the grooves 108; the two grooves are parallel to each other.

Just as the slide 56 has the raised portions 104 and parallel webs 103 supporting one side of the key 70, FIG. 4 shows that the bottom part 54 of the box 30 has the parallel webs 78 and raised portions 112. The key can sit on the raised portions 112.

To assist in gripping the key 70, finger grips are provided in the proximal end of the key. Additionally, a space 114 is provided for adding a number corresponding to the number of the box for which the key 70 is designed.

By selectively positioning the lugs 98 and the projections 110 on the locking arms 88 and the key 70, respectively, many unique and different lock and key combinations are possible. Further, by adding additional lugs and projections, many further uniquely different combinations are possible.

Different locking systems could alternatively be used. However, it is preferable that about 90,000 unique combinations are provided so that no two units are likely to have identical lock and key combinations.

The snap 74, as shown in FIG. 7, comprises a distal end having a clip 116 provided thereon. Further, a tab 118 is also provided at a proximal end of the snap 74. The clip 116, as previously described, engages the web 72 provided in the bottom part 54 of the box 30. The tab 118, however, is adapted to be engaged by the distal end 120 of the key 70 so as to deflect the snap 74 and release the clip 116 from the web 72 when the key is fully inserted into the box 30.

In order to assist in the aligning of he guides 96 when inserting the slide 56 into the box 30, guiding webs 122 are additionally provided in the underside 92 of the slide 56. These guiding webs 122 taper at the distal end of the slide 56 toward the snap 74. At the proximal ends of the guiding webs 122, however, the guiding webs 122 have a width substantially corresponding to the width between the grooves 108 in the web lines 94. Therefore, as the slide 56 is inserted into the box 30, the guides 96 on the locking arms 88 will be channelled into the grooves 108 by the guiding webs 122. The proximal ends of the guiding webs 122 each also have returns 124 extending substantially perpendicular to the grooves 108. These two returns 124 provide end stops against which the distal guides 96 of the locking arms 88 will engage if the slide 56 is attempted to be withdrawn from the box 30 when the guides 96 are incorrectly aligned, such as when the incorrect key is inserted or such as when the correct key has not been inserted fully.

Referring now to FIGS. 9 to 12, the rack 80 is shown. The rack is shown to support up to ten boxes. However, racks could be made to take more or less boxes. Further, multiple racks can be placed side by side or on top of each other to expand the system.

The boxes 30 are locked into place in the rack 80 by the push rods 82 that have locking bars 126 that extend the full height of the rack 80.

Each surface on the side of the rack has a protruding web 128. The web is for spacing adjacent racks 80 apart when two or more racks 80 are placed side-by-side.

The inside faces of the two sides of the rack each have ten guide recesses 130, each pair of which allows a box 30 to be slotted into the rack between them. The runners 40 on the sides 42 of the boxes 30 run in the recesses 130. The forward ends of the recesses 130 are opened to assist in the insertion of the boxes 30.

At the top of the rack 80, at the tops of the sides, push rods 82 are located. They can slide relative to the slots 46 of each box 30 that is placed in the rack. The locking bars 126 of the push rods 82 have notches in them such that when both push rods are depressed from the top, the grooves in the locking bars 126 can be aligned with the runners 40 of each box 30 so that one or more box 30 can be taken out of the rack 80.

The push rod 82 is biased or pushed back into the resting (locked) position, by a spring holder 132 at the bottom of each locking bar 126, inside the rack 80. In the locked position, the notches no longer align with the runners.

The top and bottom of the push rod 82 is supported by ribs 134 (one shown) for extra support and security for the box release mechanism. Additionally, along the length of the locking bar 126, additional flanged webs 136 provide support.

At the middle of the rack 80 stiffening webs 138, extend across the inside space of the rack 80, for extra support and sturdiness.

The back 140 of the rack 80 contains a sinless steel plate, which has two eardrop holes for wall mounting the rack 80. The steel plate is strong to allow the rack 80 to be securely mounted to the wall. Holes (and perhaps also a steel plate) may additionally, or alternatively, be placed in the bottom of the rack for attaching the rack to a shelf.

The fronts of the sides of the rack 80 have a cut outs 142 to allow for easy retrieval of boxes 30 from the rack 80.

Feet 144 are provided at the bottom of the rack so that they can be stacked while still providing access to the push rods 82.

Figure 13:
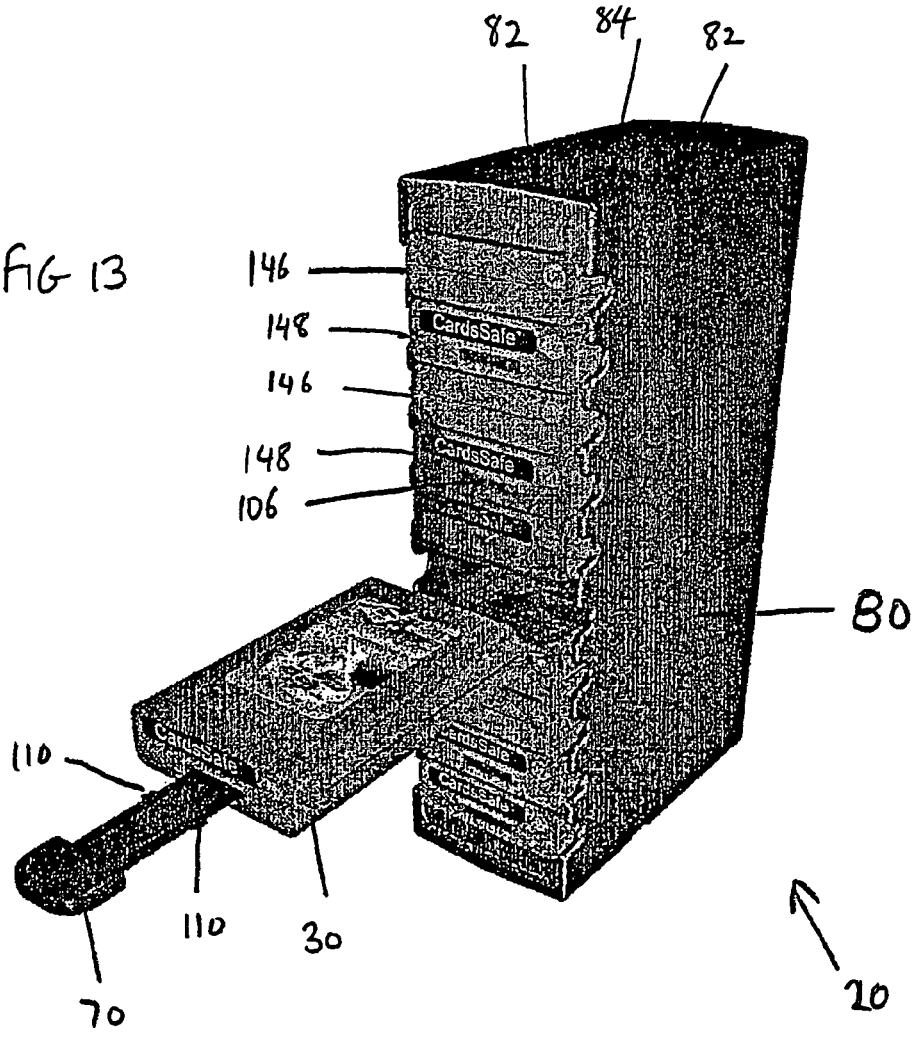
FIG. 13 shows the perspective views of the complete unit of the present invention With reference first to FIG. 13, there is shown a complete unit 20.

Referring now to FIG. 13, the depth of the rack 80 is such that unused boxes can be inserted with the grip of its key 70 extending into the rack 80 rather than out of the rack 80. This prevents the key 70 from being removed inadvertently, which would lock the slide 56 in the box. However, boxes in use 148 are inserted the other way round so that the slot 106 for the key 70 faces outwards. This lets the seller know which boxes are free.

In use, a seller may place the rack on a counter top in his workplace, visible to the customers, or under it, for example, and a customer needing to leave security or a deposit for the seller in order to run a tab or to use the seller's services, will take or will be given a box, place his credit card in the box, remove the unique key and keep the key. The box will then be returned to the rack with the credit card secured in it. Then, when returning, the customer will use the key to regain access to his card and pay the seller for services used.

In an alternative embodiment, as described and shown in the drawings of GB0228448.7, the entire contents of which are incorporated herein by way of reference, the box or container is locked in a secure condition with two securing bolts. The bolts require a key to unlock them. A locking means slides across the body of the container using a tongue and groove design. The key has a protrusion, which stops it at the right location. The locking bolts are kept secure by springs pushing them into the opening in the inside slide guide. The key enters the housing part, through a hinged opening hatch, and the lock releases the bolts by depressing the levers on the inside. The housing is prevented from becoming separated from the body through a spring-lock release mechanism.

As with the first embodiment, the box of the second embodiment can only be opened with the unique key. However, it works instead by depressing the securing bolts through exerting downward pressure on the inside.

Instead of a box, the cards safe may instead just have separate compartments. Alternatively, other forms of container for the deposit or security may be provided.

Instead of the above locking designs, the lock can be of an alterative design. For example it may be operated through mechanical or magnetic means.

The products of the present invention therefore enable the system of the present invention to be put into effect at an establishment requiring consumers to provide a deposit or security.

The present invention also provides a method of using the above products generally as described above.

The present invention has been described above purely by way of example. It should be noted that modifications in detail may be made within the scope of the invention.

The invention claimed is:

1. A box with an attachable slide removable by operation of a key and the box is attachable to a rack, comprising: a top part with a pair of slots each situated on an exterior side of the top part; a bottom part with an entry opening, a web and a pair of slots and a pair of runners situated on exterior sides of the bottom part, a pair of locking arms situated on the bottom part and each locking arm has a distal guide, an entry guide and a lug; the slide having a pair of channels each defined by a pair of webs, a distal end of the slide comprises a snap with a clip engageable by a tab, the snap is situated in-between a pair of returns each accompanied with a guide web; the rack is a parallelopipedon with a rack opening, at least one pair of guide recesses in the rack and a pair of push rods insertable into the rack from top to bottom; wherein the box is formed by coupling the top part to the bottom part; wherein the slide is removably insertable into the entry opening whereby the pair of guide webs direct the pair of distal guides into the pair of channels and the slide is locked to the box when the tab is engaged onto the web and the pair of distal guides are engaged onto the pair of returns; wherein the slide is removable from the box upon insertion of the key into the entry opening, a distal end of the key disengages the clip from the web by pushing against the tab, and at lease one outwardly extending projections disengage the pair of distal guides from the pair of returns by displacing the pair of lugs; wherein the box is removeably secured to the rack by inserting the pair of runners into the pair of guide recesses via the rack opening and by inserting the pair of push rods into the rack from top to the bottom through the slots of the top and bottom parts.

2. A storage apparatus, comprising:

a plurality of containing means for containing;

a plurality of sliding means for sliding, each sliding means having a pair of channels each defined by a pair of webs, a distal end of the sliding means having a snap with a clip engagable by a tab, the snap being situated in-between a pair of returns each accompanied with a guide web; and a storage means for storing;

wherein one sliding means is removeably secured in one containing means by a lock and the containing means are removeably secured to the storage means, wherein each containing means has only one sliding means and each sliding means and containing means has only one lock between them, and wherein each sliding means is removeably secured in each containing means by different keyed locks which are also separate mechanisms independent from how the containing means is removeably secured to the storage means.

3. The storage apparatus of claim 2, further comprising a key for releasing a locking action securing the sliding means to the containing means.

4. The storage apparatus of claim 2, further comprising a pair of push rods for securing the containing means to the storage means and for releasing the containing means from the storage means.

5. The storage apparatus of claim 2, wherein the containing means is formed by coupling a top part to a bottom part to enclose the sliding means and to render a pair of coincide slots on two sides of the containing means.

6. The storage apparatus of claim 5, wherein the top part has a pair of top slots situated on a plurality of exterior sides of the top part.

7. The storage apparatus of claim 6, wherein the bottom part has an entry opening, a web and a pair of slots and a pair of runners situated on exterior sides of the bottom part, a pair of locking arms situated on the bottom part and each locking arm has a distal guide, an entry guide and a lug.

8. The storage apparatus of claim 7, wherein the pair of coincide slots are formed by aligning the pair of top slots with the pair of bottom slots.

9. The storage apparatus of claim 7, wherein the storage means is a parallelopipedonal rack with a rack opening for each container means, at least two pairs of guide recesses in the storage means and at least one push rod insertable into the storage means from top to bottom.

10. The storage apparatus of claim 9, wherein the sliding means is removeably insertable into the entry opening whereby the pair of guide webs direct the pair of distal guides into the pair of channels and the slide is locked to the containing means when the tab is engaged onto the web while the pair of distal guides are engaged onto the pair of returns.

11. The storage apparatus of claim 10, wherein the sliding means is removable from the containing means upon insertion of the key into the entry opening, a distal end of the key disengages the clip from the web by displacing the tab, while at lease one of outwardly extending projections displaces the pair of distal guides from the pair of returns displace the pair of lugs.

12. The storage apparatus of claim 11, wherein the containing means is removeably secured to the rack by inserting the pair of runners into the pair of guide recesses via the rack opening and by inserting the pair of push rods into the storage means from top to bottom through the slots of the top and bottom parts.

13. The storage apparatus of claim 2, wherein the containing means has a front side and a back side, and either of the front side and the back side is insertable into the storage means.

14. A security apparatus, comprising:

a top part having a pair of top slots on it sides;

a slide having a pair of channels, a clip, a pair of returns, a pair of guide webs and a tab; and a bottom part having a pair of bottom slots on its sides, a web, a pair of runners, an entry opening for the slide and a key leading to a pair of locking arms each with a distal guide;

wherein a box is formed by coupling the top part to the bottom part and forming a pair of coincide slots exterior to the box by having the pair of top slots coincide with the pair of bottom slots, and wherein the box completely contains the pair of locking arms and each arm contacted by the key to either lock or allow the slide to move thereby opening the security apparatus.

15. The security apparatus of claim 13, wherein the slide is insertable into the box via the entry opening whereby the pair of guide webs directs the pair of distal guides into the pair of channels until the pair of distal guides engages the pair of returns and the clip engages the web to retainably secure the slide in the box.

16. The security apparatus of claim 15, wherein a key is insertable into the entry opening whereby as a distal end of the key pushes toward the tab to disengage the clip from the web, a pair of outwardly extending projections of the key displaces the pair of lugs to disengage the pair of distal guides from the pair of returns so as to remove the slide from the box.

17. The security apparatus of claim 15, further comprising: a parallelopipedonal rack having a rack opening, at least one pair of guide recesses, at least one rack channel extending from top to bottom of the parallelopipedonal rack and at least one push rod.

18. The security apparatus of claim 17, wherein a front side of the box is inserted into the parallelopipedonal rack whereby the pair of runners resides in the pair of guide recesses and the at least one push rod is inserted into the rack channel through at least one of the pair of coincide slots, and wherein the entry opening is hidden inside the rack thus is inaccessible to the key.

19. The security apparatus of claim 17, wherein a back side of the box is inserted into the parallelopipedonal rack whereby the pair of runners resides in the pair of guide recesses and the at least one push rod is inserted into the rack channel through at least one of the pair of coincide slots, and wherein the entry opening faces the rack opening thus is accessible to the key.

20. The security apparatus of claim 19, further comprises at least one pair of flange webs affixed to an interior side of the rack about the at least one rack channel to isolate movements of the at least one push rod.

21. The security apparatus of claim 20, further comprises a rib affixed to an interior portion of the rack so as to receive one end of the at least one push rod.

22. The security apparatus of claim 21, further comprises a spring holder affixed in the rib to retain a spring to provide a spring action to the at least one push rod.

23. The security apparatus of claim 19, further comprising a plurality of locking bars spaced apart from each other to form intermittent voids there-in-between on the at least one push rod so that when any of the voids is in alignment with one of the at least one pair of guide recesses, the runner is permitted to slide therein the guide recesses through any one of the intermittent voids.

24. The security apparatus of claim 23, wherein after insertion of the runner into one of the at least one pair of guide recesses and any of the intermittent voids, a position of the at least one push rod is displaced along the at least one rack channel so that the at least one locking bar moves into one of the coincide slots to secure the box in the rack.

25. The security apparatus of claim 19, further comprises at least one stiffening web affixed between two opposite interior sides of the rack to reinforce structural support to the rack.

26. The security apparatus of claim 19, further comprises a plurality of protruding webs each residing on exterior and opposite sides of the rack to provide proper spacing between two racks placed side-by-side.

27. The security apparatus of claim 19, further comprising a plurality of holes on a back side of the rack so that the rack is mountable to a wall through the plurality of holes by one of a number of bolts and screws.

28. The security apparatus of claim 19, wherein a plurality of cut outs are formed by an edge of each opposite sides of the rack to provide finger access to the box residing in the rack.

29. The security apparatus of claim 14, wherein each of the pair of channels is formed by a web line and a shorter web to facilitate directing the distal guides into the pair of channels.

30. The security apparatus of claim 14, wherein the pair of locking arms each further comprises a proximal guide.

31. The security apparatus of claim 14, wherein the pair of locking arms each further comprises a lug.

32. The security apparatus of claim 31, wherein the lug is located anywhere between the distal guide and the proximal guide.

33. The security apparatus of claim 32, wherein a placement of one of the pair of lugs on one of the pair of locking arms may be different from a placement of another of the pair of lugs on another of the pair of locking arms.

34. The security apparatus of claim 32, wherein a size of one of the pair of lugs on one of the pair of locking arms may be different from a size of another of the pair of lugs on another of the pair of locking arms.

35. The security apparatus of claim 34, wherein a key enables withdrawal of a slide from the box once the pair of outwardly extending projections of the key engages the pair of lugs as the distal end of the key displaces the tab.

36. The security apparatus of claim 14, wherein adjacent the entry opening is a pair of parallel webs to support a key inside the box.

37. The security apparatus of claim 14, wherein the pair of locking arms are situated on the bottom part by mounting onto a pair of circular mounting ends.

* * * * *